US009722374B2

(12) United States Patent
Hsu et al.

(10) Patent No.: US 9,722,374 B2
(45) Date of Patent: Aug. 1, 2017

(54) STACKED RECEPTACLE CONNECTOR INTEGRATED WITH RJ-45 CONNECTOR AND USB TYPE-C CONNECTOR

(71) Applicant: FOXCONN INTERCONNECT TECHNOLOGY LIMITED, Grand Cayman (KY)

(72) Inventors: Chih-Ching Hsu, New Taipei (TW); Jun-Hua Hu, Kun Shan (CN); Zhi-Hui Tang, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/176,154

(22) Filed: Jun. 8, 2016

(65) Prior Publication Data

US 2016/0359284 A1 Dec. 8, 2016

(30) Foreign Application Priority Data

Jun. 8, 2015 (CN) ..... 2015 1 0307556

(51) Int. Cl.

| | |
|---|---|
| ***H01R 27/02*** | (2006.01) |
| ***H01R 12/71*** | (2011.01) |
| *H01R 13/717* | (2006.01) |
| *H01R 24/64* | (2011.01) |
| *H01R 24/60* | (2011.01) |

(Continued)

(52) U.S. Cl.

CPC ..... *H01R 27/02* (2013.01); *H01R 12/716* (2013.01); *H01R 13/6594* (2013.01); *H01R 13/7175* (2013.01); *H01R 24/60* (2013.01); *H01R 24/64* (2013.01); *H01R 2107/00* (2013.01)

(58) Field of Classification Search

CPC .. H01R 12/724; H01R 13/659; H01R 13/665; H01R 13/715; H01R 13/717; H01R 13/6581; H01R 13/7175; H01R 13/7193; H01R 23/7073; H01R 24/50; H01R 24/60;

(Continued)

(56) References Cited

U.S. PATENT DOCUMENTS

| | | | | |
|---|---|---|---|---|
| 5,759,067 | A | 6/1998 | Scheer | |
| 6,508,665 | B1 * | 1/2003 | Yeh | H01R 13/6658 439/541.5 |

(Continued)

*Primary Examiner* — Tulsidas C Patel
*Assistant Examiner* — Travis Chambers
(74) *Attorney, Agent, or Firm* — Wei Te Chung; Ming Chieh Chang

(57) ABSTRACT

A stacked receptacle connector includes an insulative housing forming a first receiving cavity extending along a front-to-back direction, a second receiving cavity stacked on the first receiving cavity along a vertical direction perpendicular to the front-to-back direction, and a mounting cavity located behind and communicating with the first and second receiving cavities. A printed circuit board (PCB) is mounted to the mounting cavity. A first connector having a front portion received in the first receiving cavity and a rear portion connected to the PCB. The first connector is fitted to be inserted by a first plug connector along two opposite direction. A plurality of contacts each has a mating portion received in the second receiving cavity and a mounting portion connected with the PCB. A plurality of footer pins connected the PCB to electrically connect the first connector and the contacts to an exterior substrate.

19 Claims, 11 Drawing Sheets

(51) Int. Cl.
*H01R 107/00* (2006.01)
*H01R 13/6594* (2011.01)

(58) Field of Classification Search
CPC ..... H01R 24/64; H01R 27/02; H01R 39/52; H01R 2107/00
USPC ..... 439/488, 490, 541.5, 620.05, 620.06, 439/620.09–620.12, 620.15–620.18, 439/620.21, 620.22
See application file for complete search history.

(56) References Cited

U.S. PATENT DOCUMENTS 6,520,799 B1 * 2/2003 Cheng ..... H01R 13/7172 439/541.5
6,733,332 B1 * 5/2004 Espenshade ..... H01R 13/659 439/541.5
6,910,917 B2 * 6/2005 Chen ..... H01R 13/518 439/490
7,044,779 B1 * 5/2006 Liu ..... H01R 24/62 439/540.1
7,083,468 B2 * 8/2006 Walker ..... H01R 13/6658 439/541.5
7,140,919 B2 * 11/2006 Yu ..... H01R 13/6625 439/541.5
7,241,181 B2 7/2007 Machado et al.
7,357,668 B2 * 4/2008 Wan ..... H01R 13/6666 439/541.5
7,384,310 B2 * 6/2008 Hu ..... H01R 24/64 439/108
8,070,512 B2 12/2011 Xuan et al.
8,206,019 B2 * 6/2012 Chen ..... G02B 6/0008 362/581
8,272,898 B2 9/2012 Chow et al.
2004/0224558 A1 * 11/2004 Wan ..... H01R 13/6658 439/541.5
2009/0298338 A1 * 12/2009 Zhang ..... H01R 23/6873 439/607.28
2014/0342617 A1 * 11/2014 Chang ..... H01R 27/02 439/676
2015/0126069 A1 5/2015 Little et al.

* cited by examiner

STACKED RECEPTACLE CONNECTOR INTEGRATED WITH RJ-45 CONNECTOR AND USB TYPE-C CONNECTOR

BACKGROUND OF THE INVENTION

1. Field of the Invention

The present invention relates to a stacked receptacle connector, and more particularly to a stacked receptacle connector integrated with an RJ-45 connector and a USB type-C connector.

2. Description of Related Arts

Current stacked receptacle connector is formed with an RJ-45 receptacle connector stacked on a USB type-A receptacle connector. Now, USB-IF (Implementers Forum) adds a USB type-C interface to fit with thin electronic product. The USB type-C connector is so thin and small, that it is difficult to integrate the USB type-C connector into the RJ-45 receptacle connector. If a USB type-C receptacle connector and an RJ-45 receptacle connector are separately mounted to a common substrate, the process of the mounting and soldering will be complex, and the substrate needs more space for mounting the receptacle connectors.

SUMMARY OF THE INVENTION

Accordingly, an object of the present invention is to provide a stacked receptacle connector including an insulative housing forming a first receiving cavity extending along a front-to-back direction, a second receiving cavity stacked on the first receiving cavity along a vertical direction perpendicular to the front-to-back direction, and a mounting cavity located behind and communicating with the first and second receiving cavities. A printed circuit board (PCB) is mounted to the mounting cavity. A first connector has a mating tongue received in the first receiving cavity. A row of top terminals have top contacting portions exposed on a top face of the mating tongue and top tail portions connected to the PCB. A row of bottom terminals have bottom contacting portions exposed on a bottom face of the mating tongue and bottom tail portions connected to the PCB. A plurality of contacts are inserted in the second receiving cavity to form a second connector. Each of contacts has a mating portion received in the second receiving cavity and a mounting portion connected with the PCB. A plurality of footer pins connected the PCB to electrically connect the first connector and the contacts to an exterior substrate. Notably, the first connector and the second connector are integrated into the insulative housing through the PCB and the stacked receptacle connector is mounted to a substrate only by one process.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to some preferred embodiments of the present invention.

Figure 1:
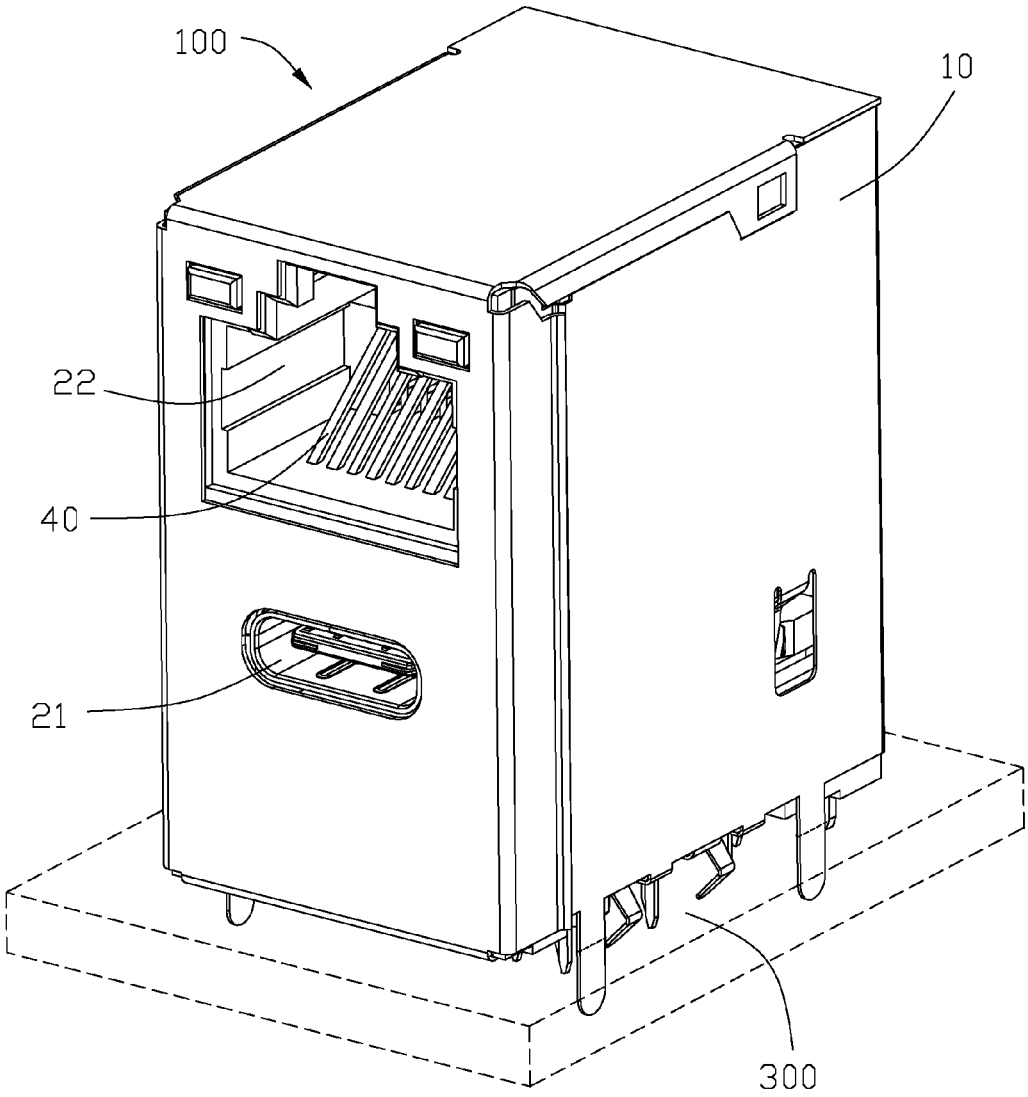
FIG. 1 is a perspective view of a stacked receptacle connector in accordance with the present invention.
Figure 2:
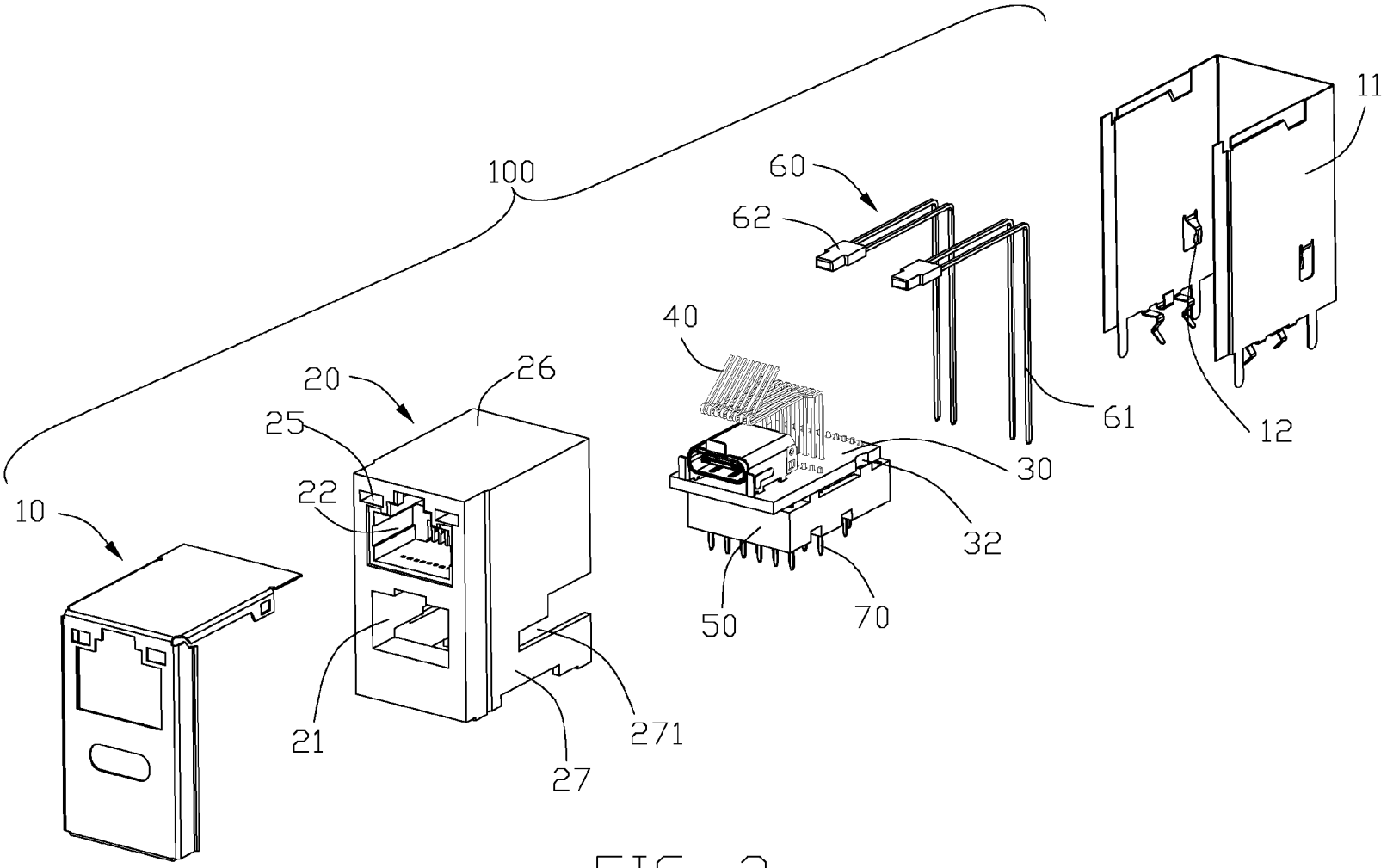
FIG. 2 is an exploded view of the stacked receptacle connector shown in FIG. 1.
Figure 3:
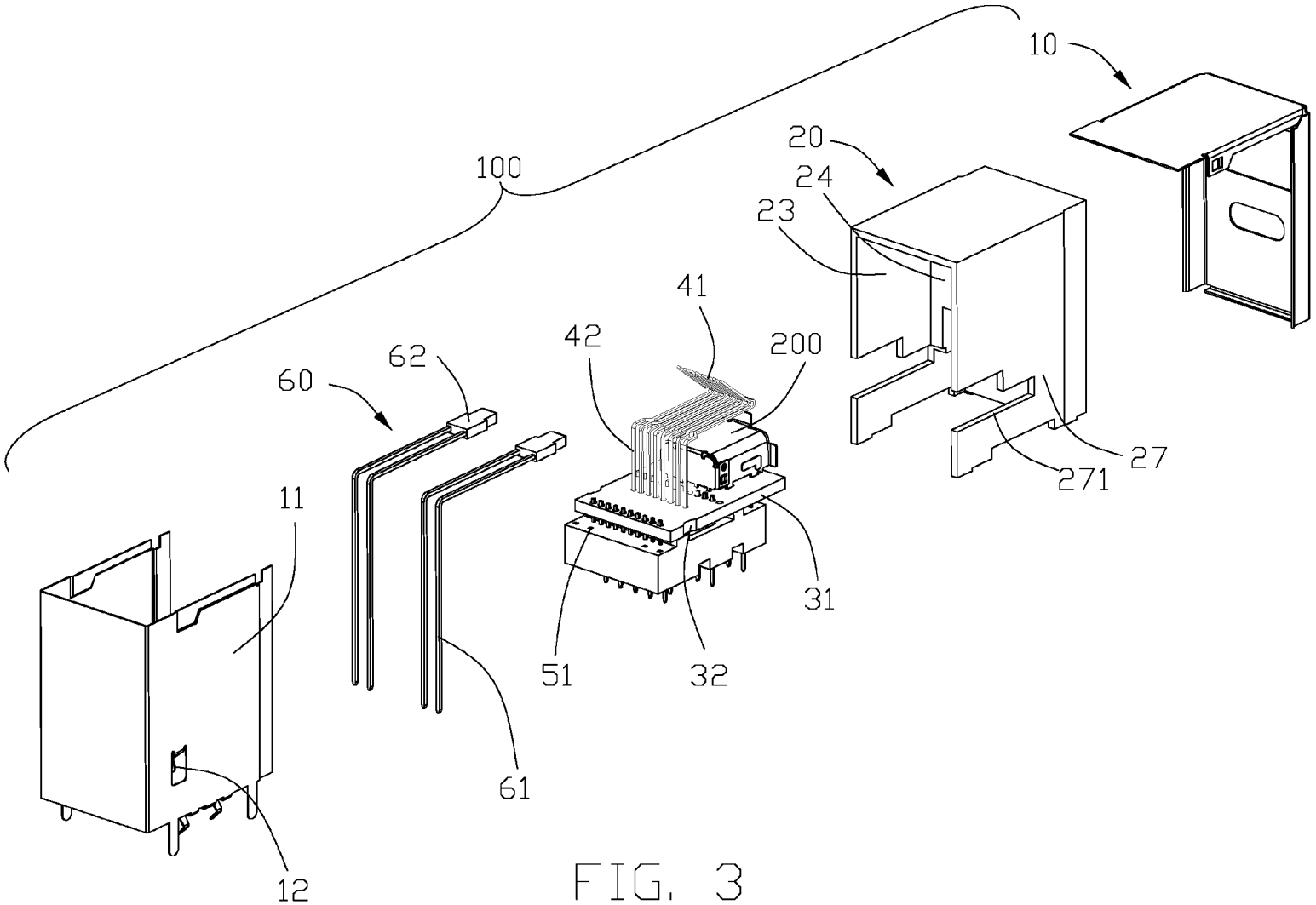
FIG. 3 is another exploded view of the stacked receptacle connector shown in FIG. 1.
Figure 4:
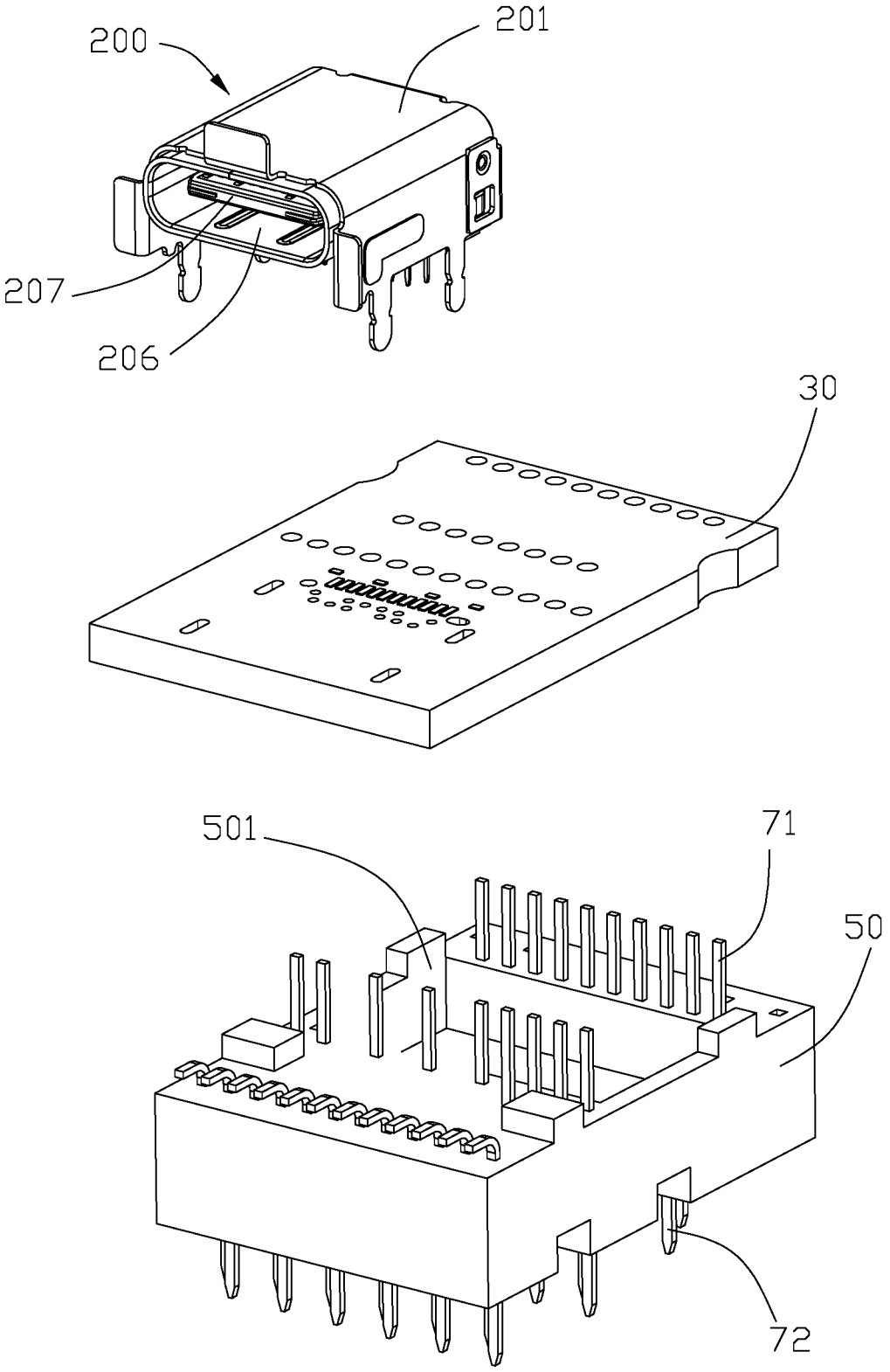
FIG. 4 is an exploded view of a first connector, a printed circuit board, an insulative carrier of the stacked receptacle connector shown in FIG. 2.
Figure 5:
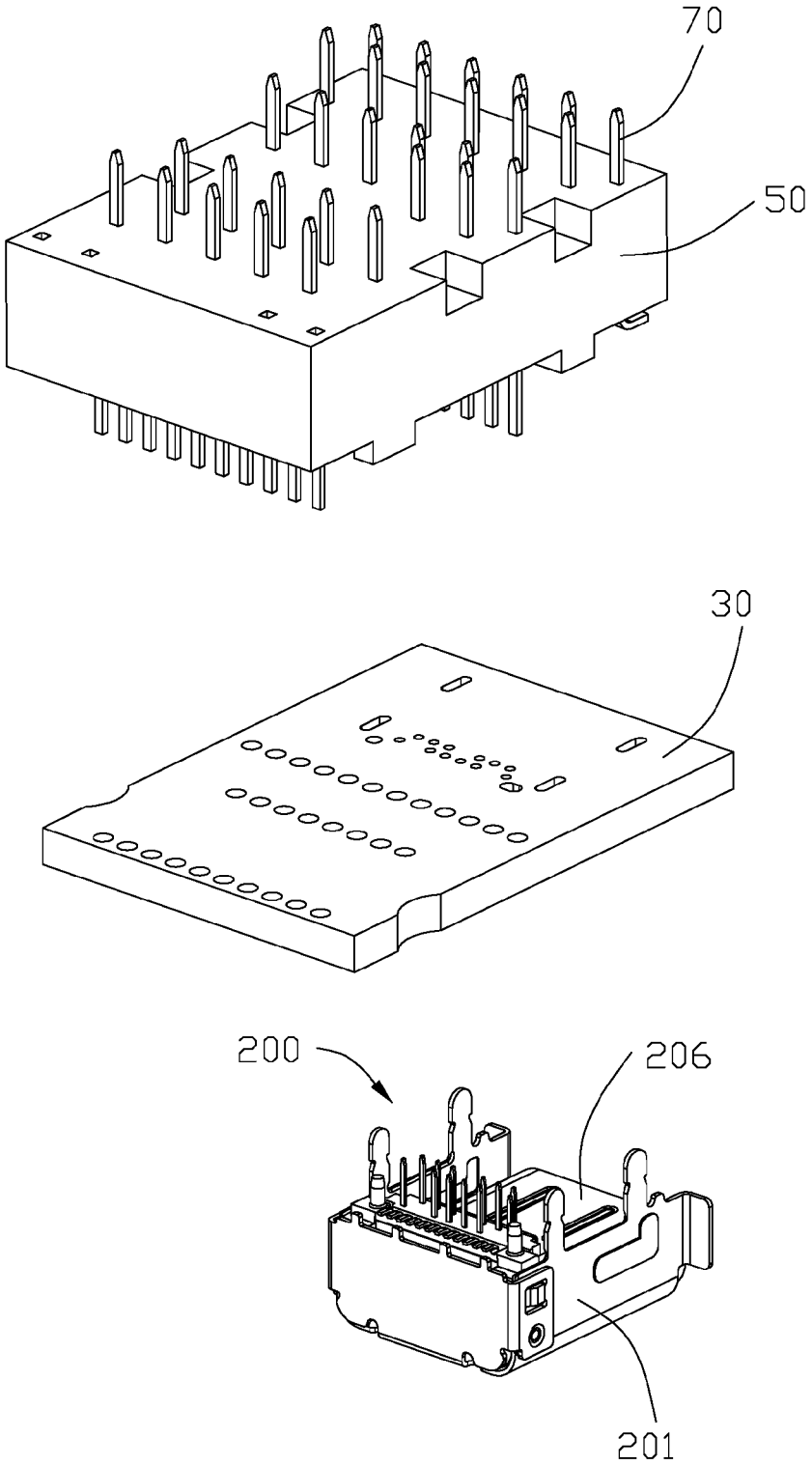
FIG. 5 is another exploded view of the first connector, the printed circuit board, the insulative carrier of the stacked receptacle connector shown in FIG. 2.
Figure 6:
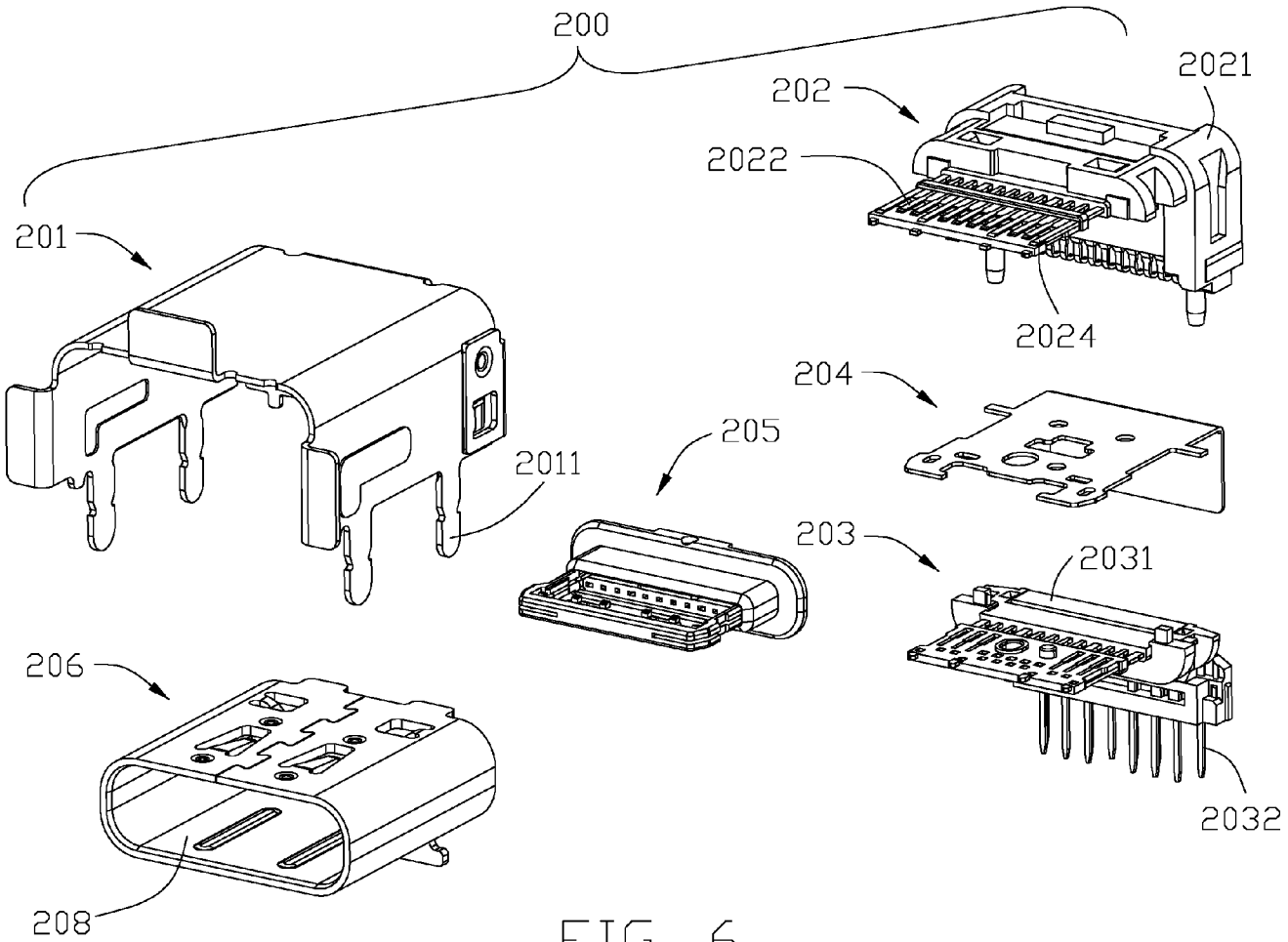
FIG. 6 is an exploded view of the first connector shown in FIG. 4.
Figure 7:
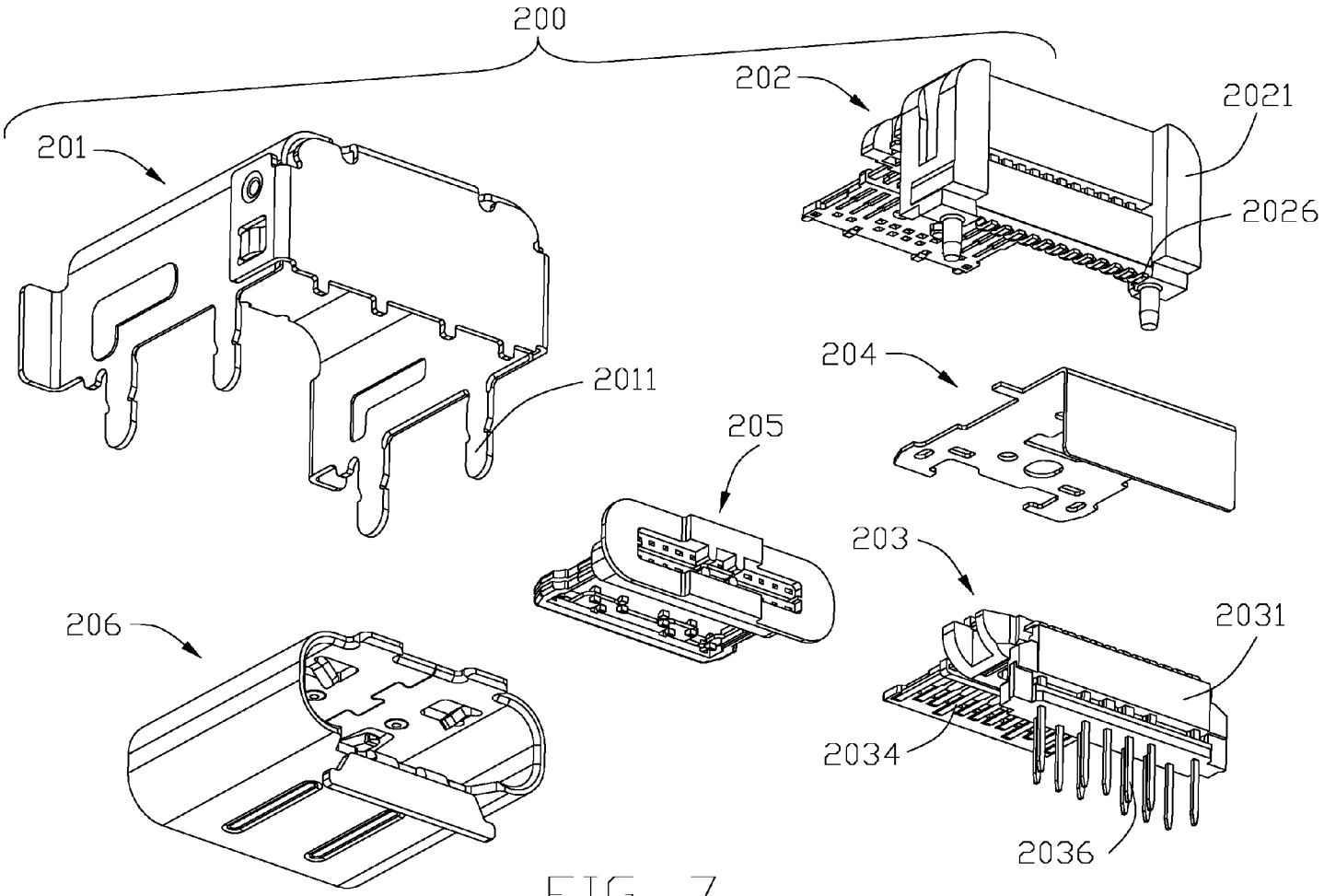
FIG. 7 is another exploded view of the first connector shown in FIG. 4.
Figure 8:
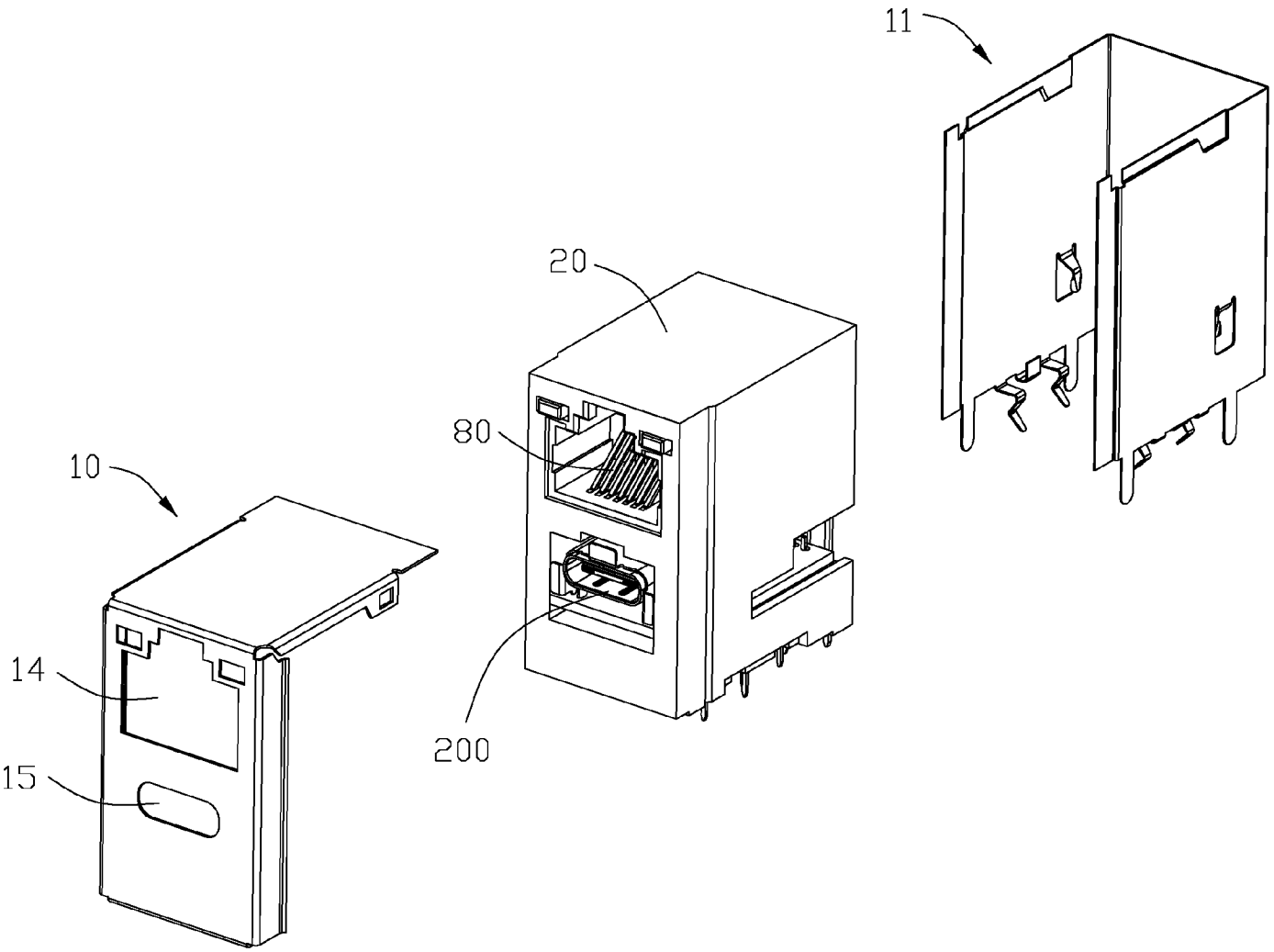
FIG. 8 is an exploded perspective view of the stacked electrical connector without the corresponding outer shell and rear shell.
Figure 9:
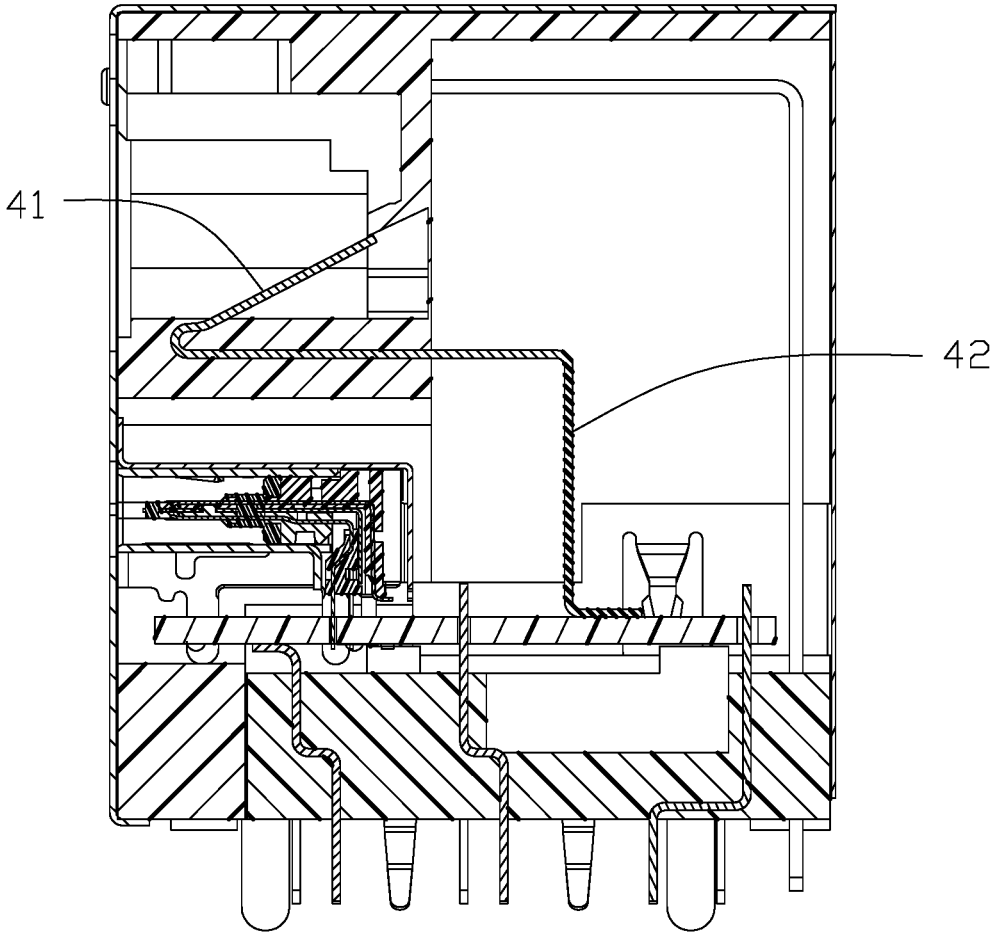
FIG. 9 is a cross-sectional view of the stacked electrical connector of FIG. 1, taken along a vertical plane extending in a front-to-back direction.
Figure 10:
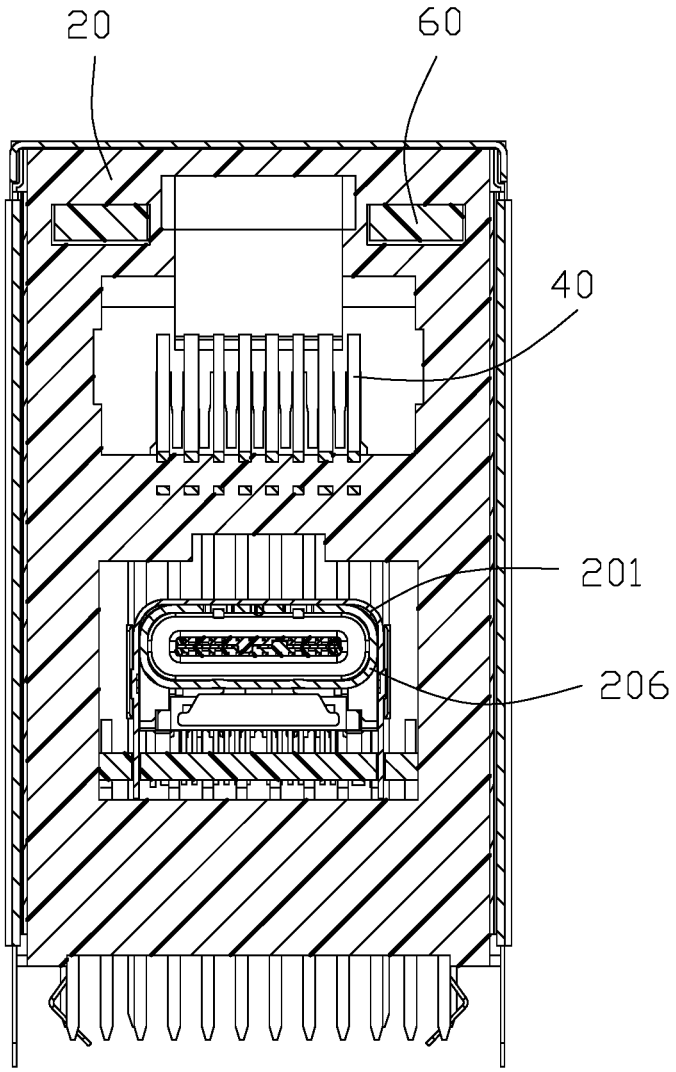
FIG. 10 is another cross-sectional view of the stacked electrical connector of FIG. 1, taken along another vertical plane extending in a transverse direction.
Figure 11:
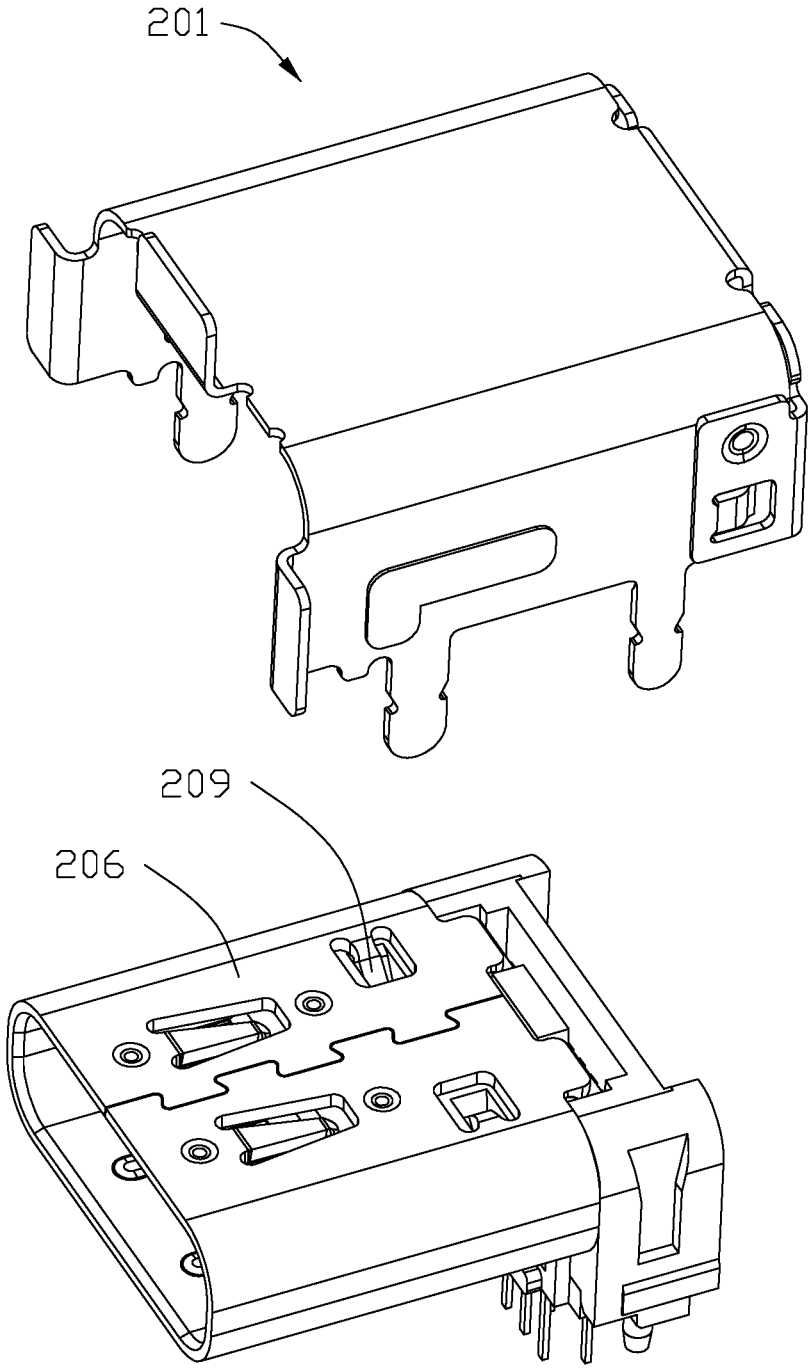
FIG. 11 is another exploded view of the first connector shown in FIG. 4.

FIGS. 1 to 10 show a stacked receptacle connector 100 including an insulative housing 20 with a first receiving cavity 21 and a second receiving cavity 22 stacked thereon along a vertical direction. The stacked receptacle connector 100 could be mounted to an exterior substrate 300. The first receiving cavity 21 and the second receiving cavity 22 extend through the insulative housing 20 along a front-to-back direction perpendicular to the vertical direction. A mounting cavity 23 is formed in the rear side of the insulative housing 20 and communicates with the first receiving cavity 21 and the second receiving cavity 22 along the front-to-back direction. A middle wall 24 is located between the second receiving cavity 22 and the mounting cavity 23. A pair of passageways 25 are formed on the insulative housing 20 and extends through the insulative housing 20 along the front-to-back direction. The passageways 25 are located above the second receiving cavity 22. The insulative housing 20 also includes a top wall 26 extending horizontally and a pair of side walls 27 extending vertically. A pair of mounting slots 271 are formed in corresponding side walls 27 and extends forwardly from a rear portion of the side walls 27.

A printed circuit board (PCB) 30 is horizontally mounted to the mounting cavity 23 and has two side edges 31 received in respective mounting slots 271 to retain with the insulative housing 20. A pair of conductive recesses 32 are formed in the side edges 31, respectively.

An insulative carrier 50 with a plurality of footer pins 70 fixed thereto. A receiving space 501 is formed in the insulative carrier 50 to receive magnetic components (not shown) such as transformers and common mode chokes mounted on a bottom surface of the PCB 30. Each of the footer pins 70 has a top end 71 connected with the PCB 30, a bottom end 72 connected to an exterior substrate, and a middle portion retained in the insulative carrier 50.

A plurality of contacts 40 are inserted in the second receiving cavity 22 to form a second connector. In this embodiment, the second connector is an RJ-45 receptacle connector. Each of the contacts 40 has a mating portion/section 41 received in the second receiving cavity 22 and a mounting portion/section 42 connected with the PCB 30.

The contacts 40 are electrically connected to corresponding footer pins 70 through the PCB 30 and the magnetic components.

A pair of indication devices 60 are mounted to the insulative housing 20. Each of the indication devices 60 includes a lighting portion 62 received in corresponding passageway 25 and a mounting leg 62 extending backwardly and downwardly therefrom. In this embodiment, the indication device 60 is a LED (Light Emitting Diode). Understandably, the indication device 60 also could be a light-pipe coordinated with a LED.

A first connector 200 of a USB type C is mounted from the mounting cavity 23 to the first receiving cavity 21. The first connector 200 includes a top terminal module 202, a bottom terminal module 203, and a shielding plate 204 sandwiched therebetween. The top terminal module 202 includes a top insulator 2021 and a row of top terminals 2022 retained thereto by an insert molding process. The bottom terminal module 203 includes a bottom insulator 2031 and a row of bottom terminals 2032 retained thereto by an insert molding process. The quantity of the top terminals 2022 is same with the quantity of the bottom terminals 2032. In this embodiment, the quantity of top terminals 2022 is twelve. An insulative body 205 is over molded on the top terminal module 202 and the bottom terminal module 203 to form a mating tongue 207. The mating tongue 207 is assembled into a first or inner shielding shell 206 along a back-to-front direction. Each of the top terminals 2022 includes a top contacting portion 2024 exposed on a top face of the mating tongue 207 and a top tail portion 2026 connected to the PCB 30. Each of the bottom terminals 2032 includes a bottom contacting portion 2034 exposed on a top face of the mating tongue 207 and a bottom tail portion 2036 connected to the PCB 30. The first shielding shell 206 defines a capsular mating cavity 208 extending therethrough along the front-to-back direction to receive the mating tongue 207. The first shielding shell 206 has a horserace contour configured to be inserted by a plug connector along two opposite directions. A second or outer shielding shell 201 assembled to the first shielding shell 206 along the vertical direction and has a plurality of bottom/mounting legs 2011 extending downwardly beyond the first shielding shell 206. In this embodiment, the first connector 200 is a USB type C receptacle connector.

An outer metal shell 10 encloses the insulative housing 20, the contacts 40, and the first connector 200 therein. The outer metal shell 10 has a pair of grounding tabs 12 extending toward the PCB 30 to electrically connect with the PCB 30. The outer metal shell 10 includes a front shell and a rear shell 11 assembled thereto. The grounding tabs 12 are stamped from the rear shell 11. The grounding tabs 12 are electrically connected to the bottom legs 2011 through the PCB 30. Notably, the metal shell 10 forms an upper opening 14 aligned with the corresponding second cavity 22 and a lower opening 15 aligned with the corresponding first cavity 21 in the front-to-back direction wherein the lower opening 15 is configured to be similar to the first shielding shell 206 while being different from the first cavity 21, and the upper opening 14 is configured to be similar to the second cavity 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A stacked receptacle connector comprising:

an insulative housing forming a first receiving cavity extending along a front-to-back direction, a second receiving cavity stacked on the first receiving cavity along a vertical direction perpendicular to the front-to-back direction, and a mounting cavity located behind and communicating with the first and second receiving cavities;

a printed circuit board (PCB) mounted to the mounting cavity;

a first connector having a mating tongue received in the first receiving cavity, a row of top terminals with top contacting portions exposed on a top face of the mating tongue and top tail portions connected to the PCB, and a row of bottom terminals with bottom contacting portions exposed on a bottom face of the mating tongue and bottom tail portions connected to the PCB;

a plurality of contacts inserted in the second receiving cavity to form a second connector, each of the contacts having a mating portion received in the second receiving cavity and a mounting portion connected with the PCB; and a plurality of footer pins connected to the PCB for electrically connecting the first connector and the second connector to an exterior substrate.

2. The stacked receptacle connector as claimed in claim 1, wherein the PCB is disposed horizontally.

3. The stacked receptacle connector as recited in claim 1, wherein the first connector is disposed in front of the mounting portions of the contacts.

4. The stacked receptacle connector as recited in claim 1, wherein the first connector has a top insulator to retain the row of top terminals, a bottom insulator to retain the row of bottom terminals, and a shielding plate sandwiched therebetween.

5. The stacked receptacle connector as claimed in claim 1, wherein the contacts and the first connector are mounted on a same surface of the PCB.

6. The stacked receptacle connector as claimed in claim 5, wherein the insulative housing includes a pair of side walls extending vertically and a pair of mounting slots formed in corresponding side walls to receive two side edges of the PCB.

7. The stacked receptacle connector as recited in claim 1, further comprising an insulative carrier to retain the footer pins, wherein the insulative carrier is disposed below the PCB and the contacts and the first connector are disposed above the PCB.

8. The stacked receptacle connector as recited in claim 7, wherein the insulative carrier includes a receiving space recessed downwardly to receive magnetic components on a bottom surface of the PCB, the contacts electrically connected to corresponding footer pins through the PCB and the magnetic components.

9. The stacked receptacle connector as recited in claim 1, further comprising a first metal shell defining a mating cavity to receive the mating tongue, the mating cavity configured to mate with a plug connector along two opposite direction.

10. The stacked receptacle connector as recited in claim 9, further comprising a second metal shell assembled to the first shielding shell along the vertical direction.

11. The stacked receptacle connector as recited in claim 9, further comprising an outer metal shell enclosing the insulative housing and having a grounding tab connecting with the PCB to electrically connect to the first metal shell.

12. A combo electrical connector assembly comprising:

a monolithic insulative housing defining a first cavity and a second cavity spaced from each other in a vertical direction, and both said first cavity and said second cavity forwardly communicating with an exterior in a front-to-back direction perpendicular to said vertical direction;

an internal printed circuit board disposed in the housing;

an electrical connector mounted upon the internal printed circuit board and received within the first cavity;

a plurality of contacts disposed in the housing, each of said contacts including a mating section exposed in the second cavity and a mounting section mechanically and electrically connected to the internal printed circuit board;

a plurality of footer pins mechanically and electrically connected to the internal printed circuit board for mounting to an external printed circuit board;

wherein the electrical connector includes an insulative body with a mating tongue enclosed within a metallic shell.

13. The combo electrical connector assembly as claimed in claim 12, wherein said metallic shell includes an inner shield with a capsular configuration, and an outer shield with a U-shaped configuration having mounting legs for mounting to the external printed circuit board.

14. The combo electrical connector assembly as claimed in claim 12, wherein said internal printed circuit board is positioned horizontally and the electrical connector is located above the external printed circuit board in the vertical direction.

15. The combo electrical connector assembly as claimed in claim 12, wherein the electrical connector is located in front of the mounting sections of said contacts in said front-to-back direction.

16. The combo electrical connector assembly as claimed in claim 12, wherein the second cavity is dimensioned and configured to snugly receive an RJ-45 plug, and the first cavity is larger than a USB type C plug while the metallic shell is dimensioned and configured to snugly receive the USB type C plug.

17. The combo electrical connector assembly as claimed in claim 16, wherein a metallic shield encloses the housing and forms a first opening aligned with the first cavity in the front-to-back direction, and a second opening aligned with the second cavity in the front-to-back direction, and the second opening is configured and dimensioned to comply with the second cavity while the first opening forms a capsular configuration to comply with the shell of the electrical connector while differ from the first cavity.

18. The combo electrical connector assembly as claimed in claim 12, wherein an insulative carrier, in which the footer pins are located, is mounted upon the internal printed circuit board, and a plurality of magnetic component is received within the insulative carrier.

19. The combo electrical connector assembly as claimed in claim 18, said housing is further equipped with a pair of LEDs each with a lead which extends behind the internal printed circuit board and received in the insulative carrier.

* * * * *